US006484865B1

(12) United States Patent
Hibari et al.

(10) Patent No.: US 6,484,865 B1
(45) **Date of Patent: *Nov. 26, 2002**

(54) COIN DISCRIMINATING APPARATUS

(75) Inventors: Eiko Hibari, Saitama (JP); Junichi Arikawa, Saitama (JP)

(73) Assignee: Laurel Bank Machines Co., Ltd., Tokyo (JP)

( * ) Notice: Subject to any disclaimer, the term of this patent is extended or adjusted under 35 U.S.C. 154(b) by 49 days.

This patent is subject to a terminal disclaimer.

(21) Appl. No.: 09/638,640

(22) Filed: Aug. 14, 2000

(30) Foreign Application Priority Data

Aug. 17, 1999 (JP) ..... 11-230325

(51) Int. Cl.[7] ..... G07D 5/00

(52) U.S. Cl. ..... 194/330; 194/328; 194/317; 382/136

(58) Field of Search ..... 194/328, 330, 194/317; 382/136

(56) References Cited

U.S. PATENT DOCUMENTS

| | | | | |
|---|---|---|---|---|
| 5,431,270 A | * | 7/1995 | Wohlrab et al. | 194/318 |
| 5,538,123 A | * | 7/1996 | Tsuji | 194/303 |
| 5,547,061 A | * | 8/1996 | Itako et al. | 194/203 |
| 5,729,623 A | * | 3/1998 | Omatu et al. | 382/135 |
| 6,328,150 B1 | * | 12/2001 | Hibari | 194/317 |

FOREIGN PATENT DOCUMENTS

| | | |
|---|---|---|
| EP | 0 683 473 | 11/1995 |
| EP | 1 049 054 | 11/2000 |
| JP | 06150104 | 5/1994 |
| JP | 8-36661 | 2/1996 |
| JP | 09097363 | 4/1997 |
| JP | 10222716 | 8/1998 |

* cited by examiner

*Primary Examiner*—Donald P. Walsh
*Assistant Examiner*—Jeffrey A. Shapiro
(74) *Attorney, Agent, or Firm*—Cohen, Pontani, Lieberman & Pavane

(57) ABSTRACT

A coin discriminating apparatus includes a coin passage member, a first transporting belt disposed above the coin passage member, thereby transporting it, a first light source, a first light detector, a second transporting belt for supporting the lower surface of the coin, a coin passage forming member disposed above the second transporting belt, a second light source, a second light detector, a first pattern data memory for storing the pattern data of the lower surface of the coin, a second pattern data memory for storing the pattern data of the upper surface of the coin, a reference pattern data memory for storing reference pattern data of coins of each denomination, a discriminator for comparing the pattern data of the lower surface of the coin with the reference pattern data of coins of each denomination and comparing the pattern data of the upper surface of the coin with the reference pattern data of coins of each denomination, thereby discriminating whether or not the coin is acceptable and the denomination of the coin.

20 Claims, 6 Drawing Sheets

COIN DISCRIMINATING APPARATUS

BACKGROUND OF THE INVENTION

The present invention relates to a coin discriminating apparatus and, in particular, to a coin discriminating apparatus for reliably discriminating whether or not coins are acceptable, whether or not coins are damaged to higher than a predetermined level and the denominations of coins by optically detecting coin surface patterns.

DESCRIPTION OF THE PRIOR ART

Conventionally, it is discriminated whether or not coins are acceptable, namely, whether coins are genuine or counterfeit and whether or not coins are current coins by detecting the diameter, material, thickness and the like of the coins. However, a coin discriminating apparatus for discriminating coins by optically detecting coin surface patterns has been recently proposed in order to improve the discriminating accuracy.

For example, Japanese Patent Application Laid-Open No. 8-36661 proposes a coin discriminating apparatus which is provided with a magnetic sensor disposed in a coin passage for detecting magnetic properties of coins, a number of light emitting elements such as light emitting diodes for projecting light onto coins being transported on a transparent passage portion formed in the coin passage from the lower portion and a CCD (Charge Coupled Device) for photoelectrically detecting light emitted from the light emitting elements and reflected by the surface of a coin and discriminates whether or not coins are acceptable and the denominations of coins based on image pattern data of coins photoelectrically detected by the CCD and digitized.

One side surface of Euro coins issued following by the currency unification in Europe is formed with a common pattern for each denomination and the other side surface thereof is formed with a pattern which differs depending upon countries issuing Euro coins. Therefore, when Euro coins are required to be classified in accordance with issuing countries of Euro coins in the Federal Banks or the like, since the above-mentioned coin discriminating apparatus discriminates coins by optically only surface patterns of one side of coins, it is impossible to classify Euro coins in accordance with issuing countries of Euro coins.

Further, since the above-mentioned coin discriminating apparatus discriminates coins by optically only surface patterns of one side of coins, even when the coin side surface whose pattern is not detected is damaged to higher than a predetermined level, such a coin cannot be discriminated as a damaged coin.

Moreover, in the case where a surface pattern of one side of a coin is detected by projecting light onto one surface of the coin being transported in a coin passage, it is impossible to detect a surface pattern of the other surface of the coin even when the other surface of the coin is irradiated with light, because a transporting belt for pressing the coin onto the surface of the coin passage and transporting it abuts against the other surface of the coin.

SUMMARY OF THE INVENTION

It is therefore an object of the present invention to provide a coin discriminating apparatus capable of discriminating whether or not coins are acceptable and the denominations of coins with high accuracy even when the coins have a common pattern on one side surface thereof but a different pattern on the other side surface thereof like Euro coins.

Another object of the present invention is to provide a coin discriminating apparatus capable of discriminating whether or not coins are damaged to higher than a predetermined level with high accuracy.

The above and other objects of the present invention can be accomplished by a coin discriminating apparatus comprising a coin passage member for supporting a lower surface of a coin, a first transporting belt disposed above the coin passage member adapted for forming a coin passage between the coin passage member and itself and holding the coin between the coin passage member and itself, thereby transporting it, a first light source for emitting light via a first transparent passage portion formed in the coin passage. member toward the lower surface of the coin being transported on the coin passage member, first light receiving means for photoelectrically detecting light emitted from the first light source and reflected from the lower surface of the coin via the first transparent portion and producing image pattern data of the lower surface of the coin, a second transporting belt for supporting the lower surface of the coin, a coin passage forming member disposed above the second transporting belt for forming the coin passage between the lower surface thereof and the second transporting belt and holding the coin between the lower surface thereof and the second, transporting belt, thereby transporting it, a second light source for emitting light via a second transparent passage portion formed in the coin passage forming member toward an upper surface of the coin being supported and transported by the second transporting belt, second light receiving means for photoelectrically detecting light emitted from the second light source and reflected from the upper surface of the coin via the second transparent portion and producing image pattern data of the upper surface of the coin, first pattern data storing means for storing the image pattern data of the lower surface of the coin produced by the first light receiving means, second pattern data storing means for storing the image pattern data of the upper surface of the coin produced by the second light receiving means, reference pattern data storing means for storing reference pattern data of coins of each denomination, discriminating means for comparing the image pattern data of the lower surface of the coin stored in the first pattern data storing means with the reference pattern data of coins of each denomination stored in the reference pattern data storing means and comparing the image pattern data of the upper surface of the coin stored in the second pattern data storing means with the reference pattern data of coins of each denomination stored in the reference pattern data storing means, thereby discriminating whether or not the coin is acceptable and the denomination of the coin.

According to the present invention, in the region of the first light source, a coin is transported while it is being pressed onto the upper surface of the first transparent passage portion formed in the coin passage member by the first transporting belt and is irradiated via the first transparent portion with light emitted from the first light source disposed below the coin passage member and light reflected from the lower surface of the coin is photoelectrically detected by the first light receiving means, thereby producing pattern data of the lower surface of the coin. Further, the coin is transported while the lower surface thereof is being supported by the second transporting belt so that it is being pressed onto the lower surface of the coin passage forming member provided above the second transporting belt and is irradiated via the second transparent passage portion formed in the coin passage forming member with light emitted from the second light source disposed above the coin passage forming member and light reflected from the upper surface of the coin is photoelectrically detected by the second light receiving means, thereby producing pattern data of the upper surface of the coin. Therefore, it is possible to detect optical patterns of both surfaces of a coin in a desired manner while the coin is being transported, and discriminate, based on the thus obtained pattern data of both surfaces of the coin, whether or not the coin is acceptable and the denomination of the coin. Furthermore, according to the present invention, since the discriminating means discriminates whether or not a coin is acceptable and the denomination of the coin by comparing the image pattern data of the lower surface of the coin stored in the first pattern data storing means with the reference pattern data of coins of each denomination stored in the reference pattern data storing means and comparing the image pattern data of the upper surface of the coin stored in the second pattern data storing means with the reference pattern data of coins of each denomination stored in the reference pattern data storing means, even when coins such as Euro coins whose one surface pattern is common but whose other surface pattern is different are to be discriminated, it is possible to reliably discriminate whether or not the coin is acceptable and the denomination of the coin and to sort Euro coins into those of each issuing country when Euro coins are required to be sorted by issuing country.

In a preferred aspect of the present invention, the second transporting belt is provided so as to project upward from an opening formed in the coin passage member.

According to this preferred aspect of the present invention, the coin passage member can be provided over the entire coin passage and, therefore, it is possible to manufacture the coin discriminating apparatus in a simple manner.

In another preferred aspect of the present invention, the coin passage member is cut off in the region of the second transporting belt.

In a further preferred aspect of the present invention, the first light source is disposed upstream of the second light source with respect to a coin transporting direction.

In another preferred aspect of the present invention, the first light source is disposed downstream of the second light source with respect to a coin transporting direction.

In a further preferred aspect of the present invention, the first light receiving means and the second light receiving means are constituted as monochromatic type sensors and the coin discriminating apparatus further comprises a third transporting belt for holding the coin between the coin passage member and itself, thereby transporting it, a third light source for emitting light toward the lower surface of the coin being transported on the coin passage member by the third transporting belt via a third transparent passage portion formed in the coin passage member, third light receiving means for photoelectrically detecting light emitted from the third light source and reflected from the lower surface of the coin via the third transparent passage portion and producing color data of the lower surface of the coin, a fourth transporting belt for supporting the lower surface of the coin, a coin passage forming member disposed above the fourth transporting belt for forming the coin passage between the lower surface thereof and the fourth transporting belt and holding the coin between the lower surface thereof and the fourth transporting belt, thereby transporting it, a fourth light source for emitting light toward the upper surface of the coin being supported and transported by the fourth transporting belt via a fourth transparent passage portion, fourth light receiving means for photoelectrically detecting light emitted from the fourth light source and reflected from the upper surface of the coin via the fourth transparent passage portion and producing color data of the upper surface of the coin, first color data storing means for storing color data of the lower surface of the coin produced by the third light receiving means, second color data storing means for storing color data of the upper surface of the coin produced by the fourth light receiving means, and reference color data storing means for storing color data of coins of each denomination, the discriminating means being constituted so as to compare the color data of the lower surface of the coin stored in the first color data storing means with the reference color data of coins of each denomination stored in the reference color data storing means and compare the color data of the upper surface of the coin stored in the second color data storing means with the reference color data of coins of each denomination stored in the reference color data storing means, thereby discriminating damage degree of the coin.

According to this preferred aspect of the present invention, whether or not the coin is acceptable and the denomination of the coin are discriminated by the first light receiving means and the second light receiving means. Further, in the region of the third light source, a coin is transported while it is being pressed onto the upper surface of the third transparent passage portion formed in the coin passage member by the third transporting belt and is irradiated via the third transparent portion with light emitted from the third light source disposed below the coin passage member and light reflected from the lower surface of the coin is photoelectrically detected by the third light receiving means, thereby producing color data of the lower surface of the coin. Furthermore, the coin is transported while the lower surface thereof is being supported by the fourth transporting belt so that it is being pressed onto the lower surface of the coin passage forming member provided above the fourth transporting belt and is irradiated via the fourth transparent passage portion formed in the coin passage forming member with light emitted from the fourth light source disposed above the coin passage forming member and light reflected from the upper surface of the coin is photoelectrically detected by the fourth light receiving means, thereby producing color data of the upper surface of the coin. The discriminating means is constituted so as to compare the color data of the lower surface of the coin with the reference color data of coins of each denomination stored in the reference color data storing means and compare the color data of the upper surface of the coin with the reference color data of coins of each denomination stored in the reference color data storing means, thereby discriminating damage degree of the coin. Therefore, it is possible to detect color data of both surfaces of a coin in a desired manner while the coin is being transported, and discriminate, based on the thus obtained color data of both surfaces of the coin, whether or not the coin is acceptable and the denomination of the coin.

In a further preferred aspect of the present invention, the fourth transporting belt is provided so as to project upward from an opening formed in the coin passage member.

According to this preferred aspect of the present invention, the coin passage member can be provided over the entire coin passage and, therefore, it is possible to manufacture the coin discriminating apparatus in a simple manner.

In another preferred aspect of the present invention, the coin passage member is cut off in the region of the fourth transporting belt.

In a further preferred aspect of the present invention, the third light source is disposed upstream of the fourth light source with respect to a coin transporting direction.

In another preferred aspect of the present invention, the third light source is disposed downstream of the fourth light source with respect to a coin transporting direction.

The above and other objects and features of the present invention will become apparent from the following description made with reference to the accompanying drawings.

DESCRIPTION OF THE PREFERRED EMBODIMENTS

Figure 1:
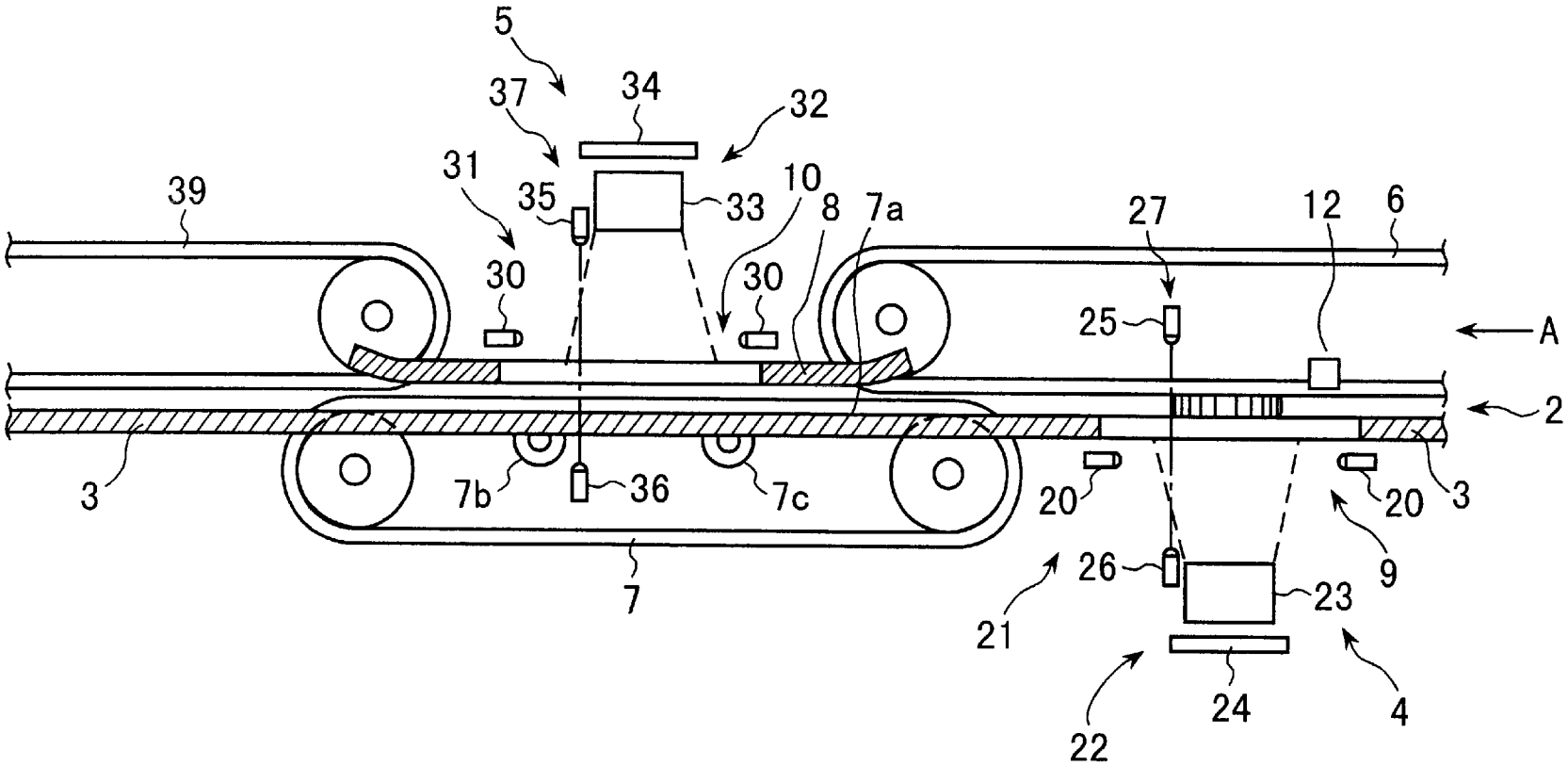
FIG. 1 is a schematic longitudinal cross-sectional view of a coin discriminating apparatus which is a preferred embodiment of the present invention.

As shown in FIG. 1, a coin passage 2 through which coins 1 are transported is provided with a coin passage member 3 extending in the transporting direction of the coins 1 over the entire distance that the coins 1 are transported. The coin discriminating apparatus includes a first pattern data detection unit 4 and a second pattern data detection unit 5. In the vicinity of the first pattern data detection unit 4, the coin passage 2 is formed by the coin passage member 3 located below and a transporting belt 6 constituted as an endless round belt. In the vicinity of the second pattern data detection unit 5, the coin passage 2 is formed by a transporting belt 7 constituted as an endless belt located to project upward from an opening 7*a* formed in the coin passage member 3 and a coin passage forming member 8 located above the transporting belt 7 and extending in the transporting direction of coins 1.

As shown in FIG. 1, the coin passage member 3 where the first pattern data detection unit 4 is provided is formed with a first transparent passage portion 9 made of transparent glass, acrylic resin or the like and the coin passage forming member 8 is formed with a second transparent passage portion 10 made of transparent glass, acrylic resin or the like.

Figure 2:
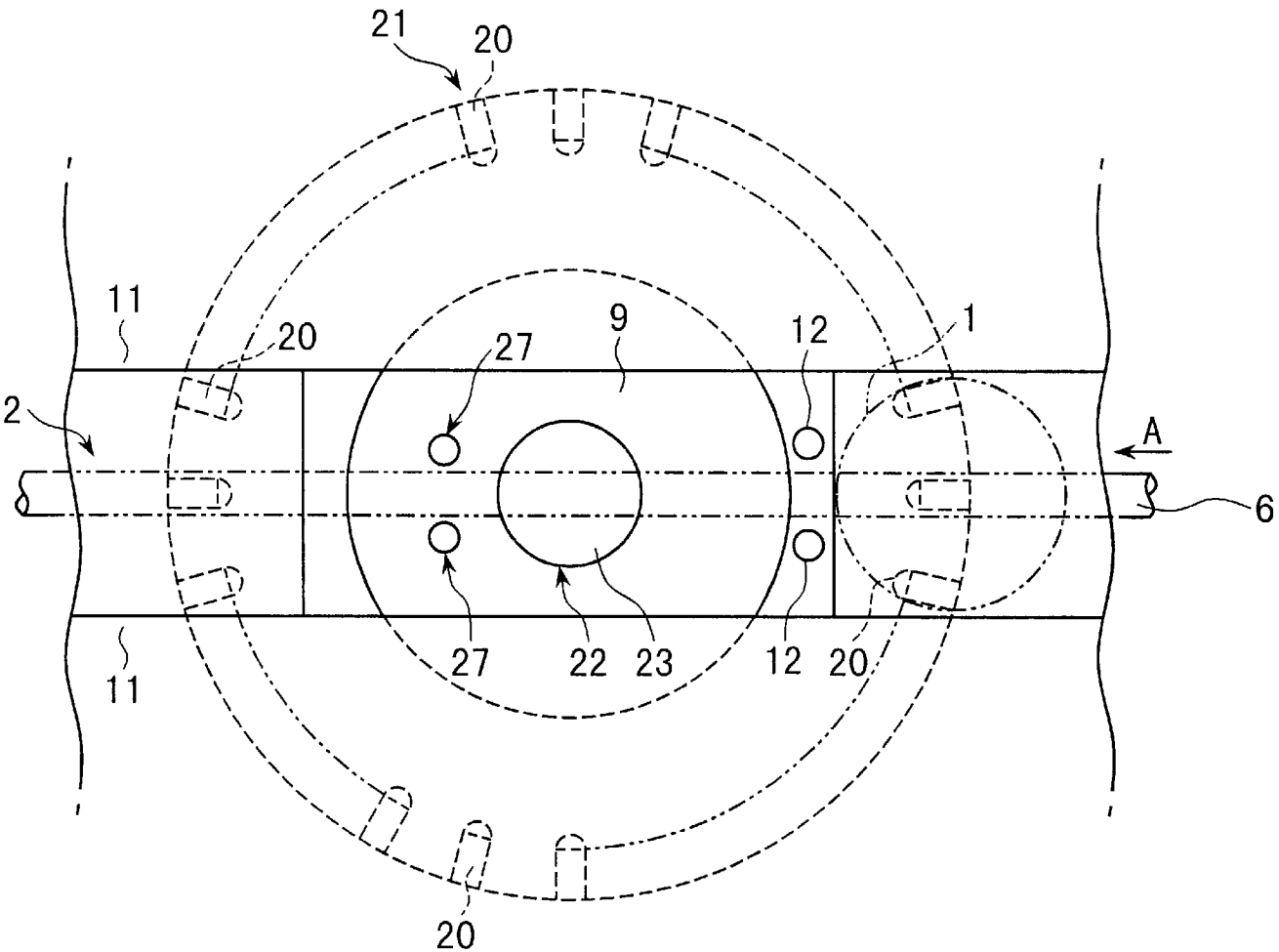
FIG. 2 is a schematic plan view of a first transparent passage portion.

FIG. 2 is a schematic plan view of the first transparent passage portion 9.

As shown in FIGS. 1 and 2, a coin 1 is fed to the first transparent passage portion 9 in the coin passage 2 along a pair of guide rails 11, 11 in the direction indicated by an arrow A by the transporting belt 6 located above the coin passage 2. A pair of magnetic sensors 12, 12 are provided for detecting magnetic properties of the coin 1 upstream of the first transparent passage portion 9 with respect to the coin transporting direction. The coin 1 is fed onto the first transparent passage portion 9, while being pressed onto the upper surface of the first transparent passage portion 9 by the transporting belt 6. Below the first transparent passage portion 9, there are provided a first light emitting means 21 including a plurality of light emitting elements 20 for emitting light toward the coin 1 passing through the first transparent passage portion 9 and a first image data producing means 22 below the first light emitting means 21 for receiving light emitted from the first light emitting means 21 and reflected by the coin 1 and producing image data. Thus, a first pattern data detection unit 4 is constituted by the first light emitting means 21 and the first image data producing means 22.

As shown in FIG. 2, the first light emitting means 21 is provided with the plurality of light emitting elements 20 such as light emitting diodes (LEDs) disposed on a circle whose center is at the center portion of the first transparent passage portion 9. Each light emitting element 20 is disposed in such a manner that the optical axis thereof is directed at a small angle with respect to the horizontal direction toward a predetermined point on a vertical axis passing through the center of a circle whose center coincides with the center portion of the first transparent passage portion 9, whereby light is projected onto the coin 1 passing through the first transparent passage portion 9 at a shallow angle with respect to the surface of the coin 1.

The first image data producing means 22 includes a lens system 23 disposed so that the optical axis thereof coincides with the vertical axis passing through the center of the circle whose center coincides with the center portion of the first transparent passage portion 9, a color sensor 24 disposed below the lens system 23 so that the focus point thereof is located on the upper surface of the first transparent passage portion 9 and adapted for photoelectrically detecting light emitted from the light emitting elements 20 and reflected by the surface of the coin 1, and an A/D converter (not shown) for converting image data of the lower surface of the coin 1 obtained by photoelectrically detecting by the color sensor 24 into digital signals, thereby producing digitized image data of the lower surface of the coin 1. In this embodiment, a two-dimensional CCD type color sensor is used as the color sensor 24.

On the immediately downstream side of the first image data producing means 22, two timing sensors 27, 27 each of which includes a light emitting element 25 and a light receiving element 26 are provided so that light emitted from the light emitting element 25 can be detected through the first transparent passage portion 9 by the light receiving element 26 and each is constituted so as to output a timing signal when the light receiving element 26 does not receive light emitted from the light emitting element 25. Each of the timing sensors 27, 27 is disposed with respect to the first image data producing means 22 so that the center of the coin 1 is located at the center of the first transparent passage portion 9 when light emitted from the light emitting element 25 is blocked by the coin 1 being transported on the surface of the first transparent passage portion 9 and is not received by the light receiving element 26, thereby outputting a timing signal.

As shown in FIG. 1, the coin 1 is pressed onto the upper surface of the coin passage member 3 by the transporting belt 6 provided above the coin passage and is transported in the first transparent passage portion 9 and the portion downstream thereof At the downstream portion of the first transparent passage portion 9, the lower surface of the coin 1 is supported by the transporting belt 7 located to project above the coin passage member 3 from the opening 7*a* formed in the coin passage member 3 and is transported in the coin passage 2 while it is being held between the transporting belt 6 and the transporting belt 7.

As shown in FIG. 1, the coin 1 is transported in the region of the downstream portion of the first transparent passage portion 9 and is fed to the second pattern data detection unit 5, while the upper surface of the coin 1 is supported by the coin passage forming member 8 and pressed onto the lower surface of the coin passage forming member 8 by the transporting belt 7. A plurality of back-up rollers 7*b*, 7*c* are provided for preventing the transporting belt 7 from being deflected downwardly due to the dead load of the coin 1.

The second pattern data detection unit 5 is provided above the second transparent passage portion 10 and includes a second light emitting means 31 including a plurality of light emitting elements 30 for emitting light toward the coin 1 passing through the second transparent passage portion 10 and a second image data producing means 32 provided above the second transparent passage portion 10 for receiving light emitted from the second light emitting means 31 and reflected by the coin 1 and producing image data. The second light emitting means 31 is constituted in a similar manner to the first light emitting means 21 except that it is disposed above the second transparent passage portion 10 and emits light downwardly and includes a plurality of light emitting elements 30 such as light emitting diodes (LEDs) arranged on the circle whose center coincides with the center portion of the second transparent passage portion 10. Each light emitting element 30 is disposed in such a manner that the optical axis thereof is directed at a small angle with respect to the horizontal direction toward a predetermined point on a vertical axis passing through the center of the circle whose center coincides with the center portion of the second transparent passage portion 10, whereby light is projected onto the coin 1 passing through the second transparent passage portion 10 at a shallow angle with respect to the surface of the coin 1.

The second image data producing means 32 includes a lens system 33 disposed so that the optical axis thereof coincides with the vertical axis passing through the center of the circle whose center coincides with the center portion of the second transparent passage portion 10, a color sensor 34 disposed above the lens system 33 so that the focus point thereof is located on the lower surface of the second transparent passage portion 10 and adapted for photoelectrically detecting light emitted from the light emitting elements 30 and reflected by the surface of the coin 1, and an A/D converter (not shown) for converting image data of the upper surface of the coin 1 obtained by photoelectrically detecting by the color sensor 34 into digital signals, thereby producing digitized image data of the upper surface of the coin 1. In this embodiment, a two-dimensional CCD type color sensor is used as the color sensor 34.

On the immediately downstream side of the second image data producing means 32, two timing sensors 37, 37 each of which includes a light emitting element 35 and a light receiving element 36 are provided so that light emitted from the light emitting element 35 can be detected through the second transparent passage portion 10 by the light receiving element 36 and each is constituted so as to output a timing signal when the light receiving element 36 does not receive light emitted from the light emitting element 35. Each of the timing sensors 37 is disposed with respect to the second image data producing means 32 so that the center of the coin 1 is located at the center of the second transparent passage portion 10 when light emitted from the light emitting element 35 is blocked by the coin 1 being transported on the surface of the second transparent passage portion 10 and is not received by the light receiving element 36, thereby outputting a timing signal.

Figure 3:
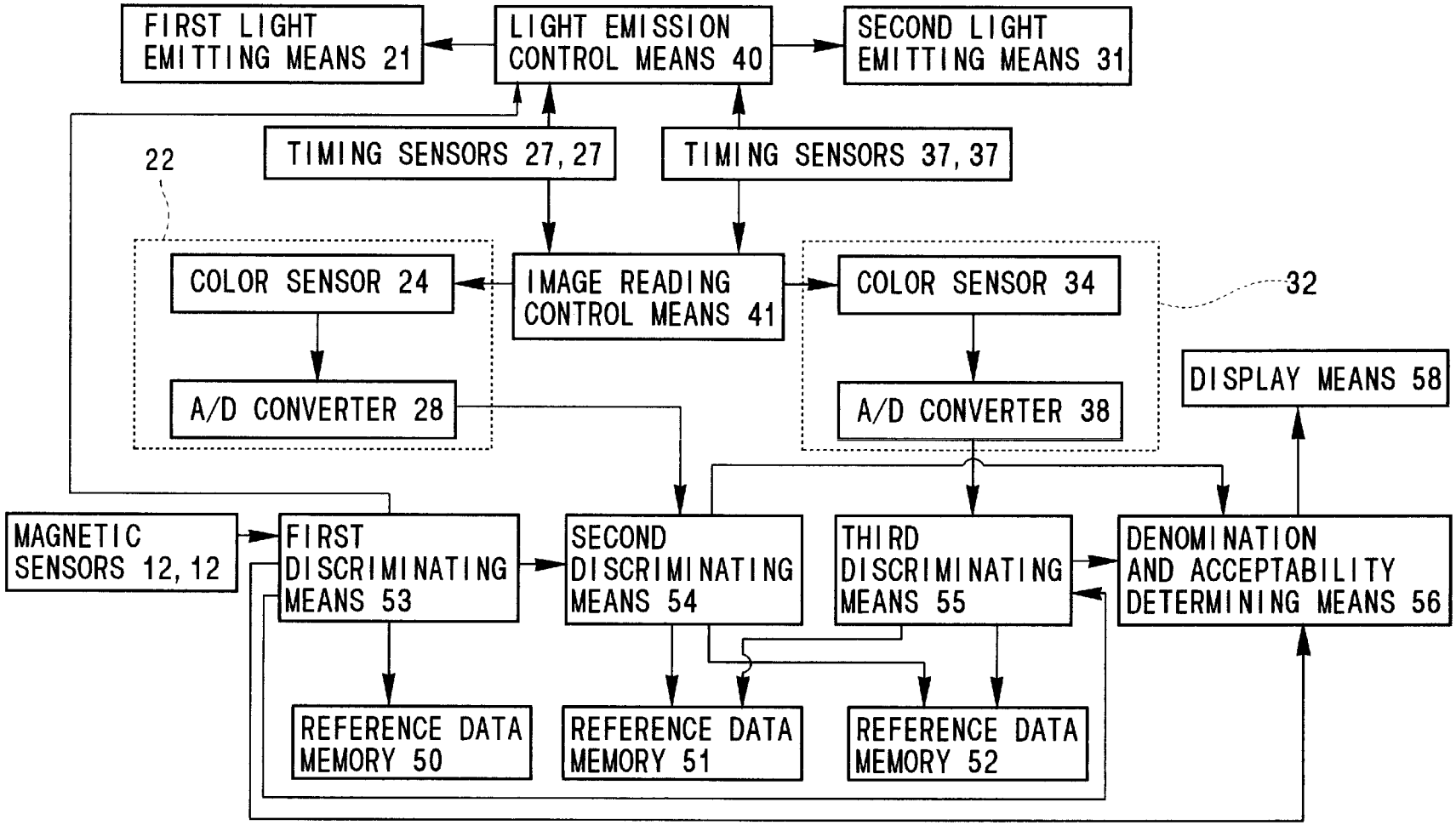
FIG. 3 is a block diagram of detection, control and discrimination systems of a coin discriminating apparatus which is an embodiment of the present invention.

FIG. 3 is a block diagram of detection, control and discrimination systems of a coin discriminating apparatus which is a preferred embodiment of the present invention.

As shown in FIG. 3, the detection system of the coin discriminating apparatus includes the two timing sensors 27, 27 for detecting a coin 1 fed to the first transparent passage portion 9 and the two timing sensors 37, 37 for detecting a coin fed to the second transparent passage portion 10.

As shown in FIG. 3, the control system of the coin discriminating apparatus includes light emission control means 40 which outputs a light emission signal to the first light emitting means 21 when the timing signal from the timing sensors 27, 27 is received and causes it to emit light and illuminate the coin 1 located on the upper surface of the first transparent passage portion 9 and outputs a light emission signal to the second light emitting means 31 when the timing signal from the timing sensors 37, 37 is received and causes it to emit light and illuminate the coin 1 located on the lower surface of the second transparent passage portion 10, and image reading control means 41 for permitting the color sensor 24 of the first image data producing means 22 to start detecting the light reflected from the surface of the coin 1 when the timing signal from the timing sensors 27, 27 is received and permitting the color sensor 34 of the second image data producing means 32 to start detecting the light reflected from the surface of the coin 1 when the timing signal from the timing sensors 37, 37 is received.

In FIG. 3, the discriminating system of the coin discriminating apparatus includes a first reference data memory 50 for storing reference magnetic data indicating magnetic properties of coins of each denomination; a second reference data memory 51 for storing reference data relating to the diameter of coins of each denomination, reference chromaticity data of coins of each denomination and reference lightness data of coins of each denomination; a third reference data memory 52 for storing reference ratio data showing the ratio of data "0" in the binary image pattern data groups corresponding to a plurality of annular areas on the surface of each denomination of coins; first discriminating means 53 which accesses the first reference data memory 50 in accordance with detection signals from the magnetic sensors 12, 12 and compares the reference magnetic data which indicate the magnetic properties of each denomination stored in the first reference data memory 50 with the magnetic data of the coin 1 input from the magnetic sensors 12, 12, thereby determining the denomination of the coin 1; second discriminating means 54 for discriminating the denomination of the coin 1 and the damage degree of the lower surface of the coin 1 based on the result of discrimination made by the first discriminating means 53, the reference data relating to the diameter of the coin of each denomination, reference chromaticity data of coins of each denomination and reference lightness data of coins of each denomination stored in the second reference data memory 51, reference ratio data stored in the third reference data memory 52 and image pattern data of the lower surface of the coin 1 photoelectrically detected by the color sensor 24 and digitized by the A/D converter 28; third discriminating means 55 for discriminating the denomination of the coin 1 and the damage degree of the upper surface of the coin 1 based on the result of discrimination made by the first discriminating means 53, the reference data relating to the diameter of the coin of each denomination, reference chromaticity data of coins of each denomination and reference lightness data of coins of each denomination stored in the second reference data memory 51, reference ratio data stored in the third reference data memory 52 and image pattern data of the upper surface of the coin 1 photoelectrically detected by the color sensor 34 and digitized by the A/D converter 38; and denomination and acceptability determining means 56 for finally discriminating whether or not the coin 1 is acceptable and the denomination of the coin 1 based on the results of discrimination made by the first discriminating means 53, the second discriminating means 54 and the third discriminating means 55.

In FIG. 3, the reference numeral 58 designates display means for displaying whether or not the coin 1 is acceptable and the damage degree of the coin 1 exceeds a predetermined level.

In this embodiment, a denomination discrimination signal is output from the first discriminating means 53 to the light emission control means 40 and the light emission control means 40 is constituted so as to control the amount of light emitted from the light emitting elements 20 and the light emitting elements 30 in accordance with the denomination discrimination signal input from the first discriminating means 53 based on the denomination of the coin 1 discriminated by the first discriminating means 53. In the third reference data memory 52, the reference ratio data of the binary image pattern data groups corresponding to each annular area of obverse and reverse surfaces of all denominations to be processed are stored.

Figure 4:
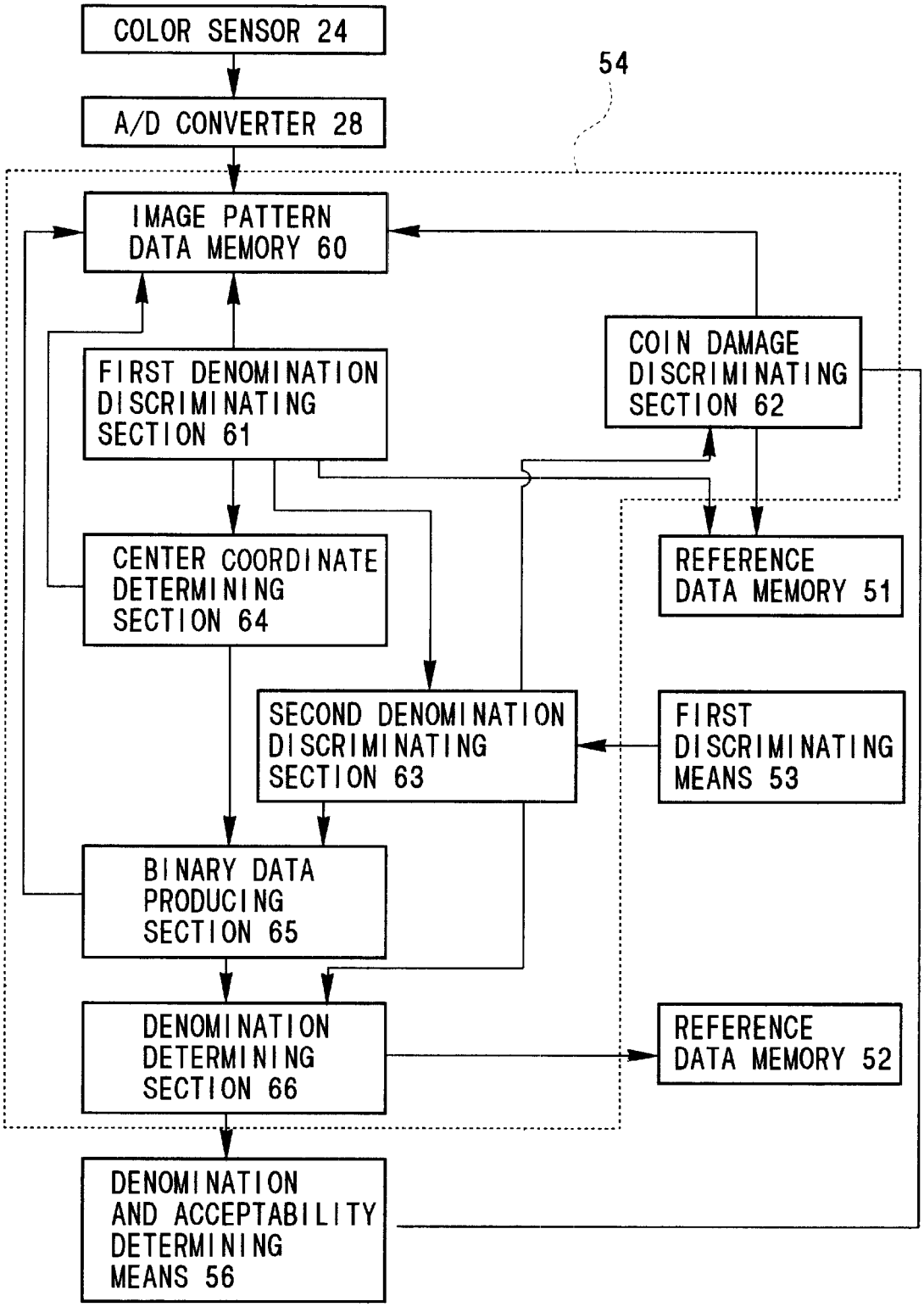
FIG. 4 is a block diagram of a second discriminating means.

FIG. 4 is a block diagram of the second discriminating means 54.

As shown in FIG. 4, the second discriminating means 54 includes an image pattern data memory 60 for mapping and storing the image pattern data of the lower surface of the coin 1 photoelectrically detected by the color sensor 24 and digitized by the A/D converter 28 into an orthogonal coordinate system, i.e., an x-y coordinate system; a first denomination discriminating section 61 which accesses the second reference data memory 51 and compares the reference data relating to the diameter of the coin of each denomination stored in the second reference data memory 51 with the image pattern data of the lower surface of the coin 1 read from the image pattern data memory 60, thereby determining the denomination of the coin 1 based on the diameter of the coin 1 and outputting a denomination discrimination signal; a second denomination discriminating section 63 for discriminating the denomination of the coin 1 based on a denomination discrimination signal input from the first discriminating means 53 and a denomination discrimination signal input from the first denomination discriminating section 61 and outputting a denomination discrimination signal; a coin damage discriminating section 62 for calculating chromaticity data and lightness data of the coin 1 based on R, G, B data corresponding to the primaries of light, namely, red, green and blue light, in the image pattern data of the lower surface of the coin 1 stored in the image pattern data memory 60, comparing them with the reference chromaticity data and reference lightness data of the coin of the denomination discriminated by the second denomination discriminating section 63 and stored in the second reference data memory 51 based on the denomination discrimination signal input from the second denomination discriminating section 63, discriminating the damage degree of the coin 1 and outputting a damage discrimination signal to the denomination and acceptability determining section 56; a center coordinate determining section 64 for obtaining the center coordinates of the image pattern data of the lower surface of the coin 1 mapped and stored in the image pattern data memory 60; a binary data producing section 65 which binarizes the image pattern data of the lower surface of the coin 1 mapped and stored in the image pattern data memory 60 and groups the binarized image pattern data into binary image pattern data groups corresponding to a plurality of annular areas of the surface of the coin 1 determined for each denomination based on a denomination discrimination signal input from the second denomination discriminating section 63 and a center coordinate signal input from the center coordinate determining section 64, obtains the number of "0" data in the binary image pattern data groups corresponding to each annular area, obtains the ratio of the "0" data in the entire data, thereby producing ratio data for each binary image pattern data group corresponding to each annular area of the surface of the coin 1; and a denomination determining section 66 which accesses the third reference data memory 52 for storing reference ratio data that indicate the ratio of the "0" data in the binary image pattern data groups corresponding to the plurality of annular areas of the coin surface of each denomination, reads the ratio data in the binary image pattern data groups corresponding to each annular area of the coin surface of the corresponding denomination according to the denomination discrimination signal input from the second denomination discriminating section 63, compares the ratio data read from the third reference data memory 52 with the ratio data of each binary image pattern data group corresponding to each annular area of the lower surface of the coin 1 input from the binary data producing section 65, thereby determining whether or not the coin 1 is acceptable and the denomination of the coin 1 and outputting a denomination determination signal to the denomination and acceptability determining means 56.

Figure 5:
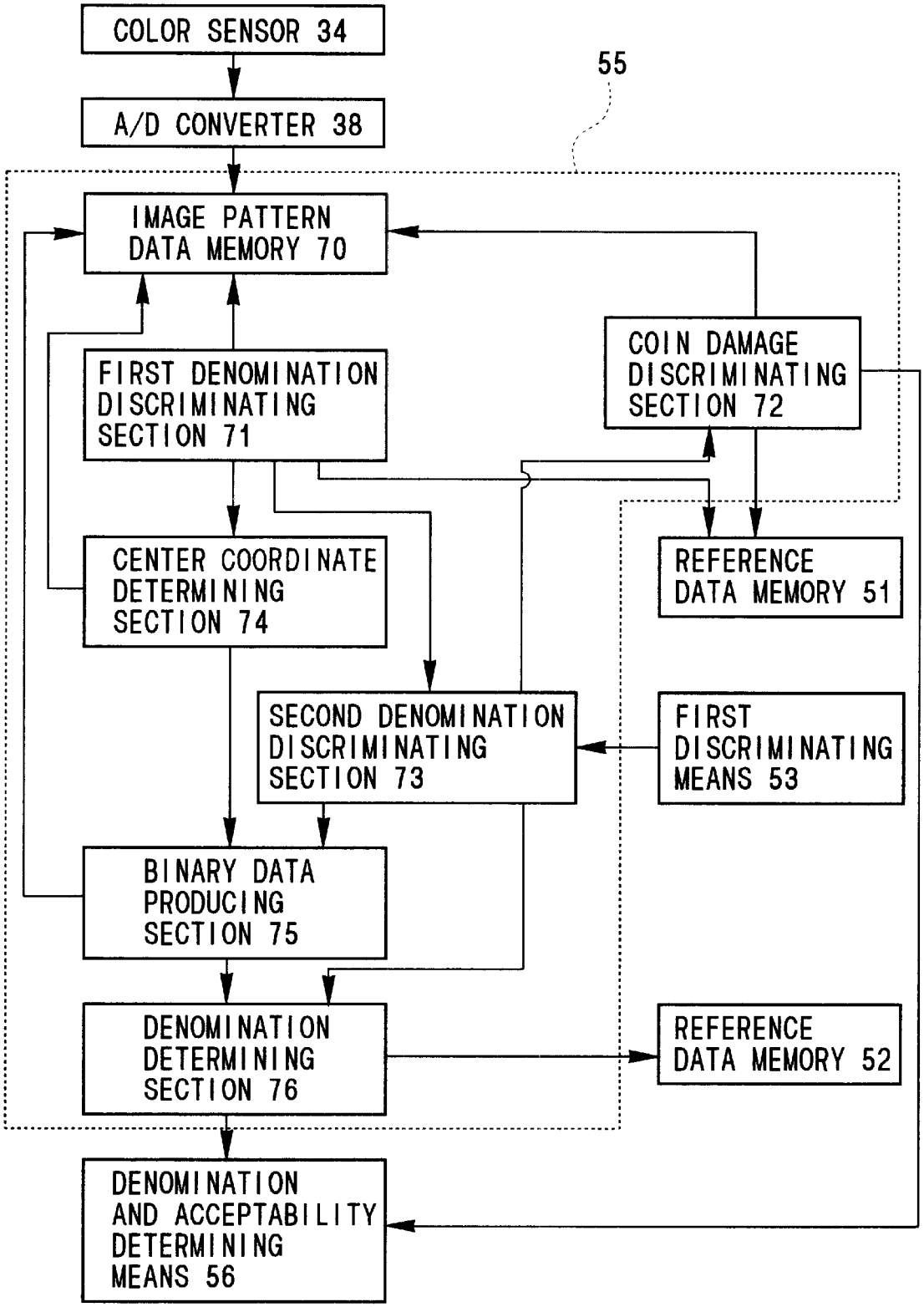
FIG. 5 is a block diagram of a third discriminating means.

FIG. 5 is a block diagram of the third discriminating means 55.

As shown in FIG. 5, the third discriminating means 55 includes an image pattern data memory 70 for mapping and storing the image pattern data of the upper surface of the coin 1 photoelectrically detected by the color sensor 34 and digitized by the A/D converter 38 into the orthogonal coordinate system, i.e., the x-y coordinate system; a first denomination discriminating section 71 which accesses the second reference data memory 51 and compares the reference data relating to the diameter of the coin of each denomination stored in the second reference data memory 51 with the image pattern data of the upper surface of the coin 1 read from the image pattern data memory 70, thereby determining the denomination of the coin 1 based on the diameter of the coin 1 and outputting a denomination discrimination signal; a second denomination discriminating section 73 for discriminating the denomination of the coin 1 based on a denomination discrimination signal input from the first discriminating means 53 and a denomination discrimination signal input from the first denomination discriminating section 71 and outputting a denomination discrimination signal; a coin damage discriminating section 72 for calculating chromaticity data and lightness data of the coin 1 based on R, G, B data corresponding to the primaries of light, namely, red, green and blue light, in the image pattern data of the upper surface of the coin 1 stored in the image pattern data memory 70, comparing them with the reference chromaticity data and reference lightness data of the coin of the denomination discriminated by the second denomination discriminating section 73 and stored in the second reference data memory 51 based on the denomination discrimination signal input from the second denomination discriminating section 73, discriminating the damage degree of the coin 1 and outputting a damage discrimination signal to the denomination and acceptability determining section 56; a center coordinate determining section 74 for obtaining the center coordinates of the image pattern data of the upper surface of the coin 1 mapped and stored in the image pattern data memory 70; a binary data producing section 75 which binarizes the image pattern data of the upper surface of the coin I mapped and stored in the image pattern data memory 70 and groups the binarized image pattern data into binary image pattern data groups corresponding to a plurality of annular areas of the surface of the coin 1 determined for each denomination based on a denomination discrimination signal input from the second denomination discriminating section 73 and a center coordinate signal input from the center coordinate determining section 74, obtains the number of "0" data in the binary image pattern data groups corresponding to each annular area, obtains the ratio of the "0" data in the entire data, thereby producing ratio data for each binary image pattern data group corresponding to each annular area of the surface of the coin 1; and a denomination determining section 76 which accesses the third reference data memory 52 for storing reference ratio data that indicate the ratio of the "0" data in the binary image pattern data groups corresponding to the plurality of annular areas of the coin surface of each denomination, reads the ratio data in the binary image pattern data groups corresponding to each annular area of the coin surface of the corresponding denomination according to the denomination discrimination signal input from the second denomination discriminating section 73, compares the ratio data read from the third reference data memory 52 with the ratio data of each binary image pattern data group corresponding to each annular area of the upper surface of the coin 1 input from the binary data producing section 75, thereby determining whether or not the coin 1 is acceptable and the denomination of the coin 1 and outputting a denomination determination signal to the denomination and acceptability determining means 56.

The thus constituted coin discriminating apparatus according to the embodiment of the present invention discriminates whether or not a coin 1 is acceptable, whether or not the coin 1 is damaged to higher than a predetermined level and the denomination of the coin 1.

The coin 1 is pressed onto the upper surface of the coin passage member 3 by the transporting belt 6 and is fed in the coin passage 2 along a pair of guide rails 11, 11 in the direction indicated by an arrow A. The magnetic properties of the coin 1 are detected by the pair of magnetic sensors 12, 12 and the detection signals are output to the first discriminating means 53.

The first discriminating means 53 accesses the first reference data memory 50 when the detection signals are input from the magnetic sensors 12, 12, reads the reference magnetic data which indicate the magnetic properties of each denomination stored in the first reference data memory 50, discriminates the denomination of the coin 1 by comparing the reference magnetic data read from the first reference data memory 50 with the magnetic data of the coin 1 input from the magnetic sensors 12, 12 and outputs denomination discrimination signals to the second discriminating means 54, the third discriminating means 55 and the light emission control means 40.

When the coin 1 is further fed in the coin passage 2 to the first transparent passage portion 9 and blocks light emitted from the light emitting element 25 of each timing sensor 27, whereby the light receiving element 26 of each timing sensor 27 does not receive the light emitted from the corresponding light emitting element 25, timing signals are output from the timing sensors 27, 27 to the light emission control means 40 and the image reading control means 41.

When the timing signals are input from the timing sensors 27, 27, the light emission control means 40 outputs a light emission signal to the first light emitting means 21 based on the denomination discrimination signal from the first discriminating means 53 and causes the light emitting elements 20 to emit the amount of light that corresponds to the denomination of the coin 1 discriminated by the first discriminating means 53 toward the lower surface of the coin 1 located on the first transparent passage portion: 9. The reason why the amount of emitted light from the light emitting elements 20 is controlled based on the discriminating result of the denomination of the coin 1 by the first discriminating means 53 is because the amount of reflected light changes depending upon the material of the coin 1. If the same amount of light is emitted toward the coin 1, the image pattern of the coin 1 cannot be accurately detected. That is, when the coin is made of a material having high light reflectivity such as nickel, aluminum or the like, it becomes difficult to accurately produce the binary data corresponding to the pattern of the surface of the coin 1 by detecting the reflected light from the surface of the coin 1. That is because the total amount of detected light becomes large and saturated if a large amount of light is illuminated. On the other hand, when the coin is made of a material having low light reflectivity such as copper, brass or the like, the binary data corresponding to the pattern on the surface of the coin 1 cannot be accurately produced by detecting the reflected light from the surface of the coin 1. That is because the total amount of detected light is too little if a small amount of light is illuminated. Thus, the light emission control means 40 is constituted such that when the coin 1 of the denomination discriminated by the first discriminating means 53 is made of a material having high light reflectivity such as nickel, aluminum or the like, the light emission control means 40 outputs a light emission signal to the first light emitting means 21 so that the light emitting elements 20 emits low intensity of light. On the other hand, it is constituted such that when the coin 1 of the denomination discriminated by the first discriminating means 53 is made of a material having low light reflectivity such as copper, brass or the like, the light emission control means 40 outputs the light emission signal to the first light emitting means 21 so that the light emitting elements 20 emits high intensity of light.

The image reading control means 41 causes the color sensor 24 of the first image data producing means 22 to start detecting the light emitted from the light emitting elements 20 and reflected on the lower surface of the coin 1 when the timing signals from the timing sensors 27, 27 are input.

Since the first light emitting means 21 is disposed so as to be able to illuminate the coin 1 which advances on the first transparent passage portion 9 at a shallow angle, the light is reflected according to the raised and depressed pattern of the lower surface of the coin 1. The light reflected from the surface of the coin 1 is directed toward the color sensor 24 by the lens system 23 and photoelectrically detected by the color sensor 24, whereby the image pattern data of the surface of the coin 1 are produced by the color sensor 24. The image pattern data of the surface of the coin 1 produced by the color sensor 24 are digitized by the A/D converter 28. The digitized image pattern data are mapped and stored in the orthogonal coordinate system, namely, x-y coordinate system in the image pattern data memory 60.

When the image pattern data of the lower surface of the coin 1 are stored in the image pattern data memory 60, the first denomination discriminating section 61 of the second discriminating means 54 accesses the second reference data memory 51. It reads the data stored in the with regard to the diameter of the coin 1 and also the image pattern data stored in the image pattern data memory 60. By comparing those data, the first denomination discriminating section 61 of the second discriminating means 54 determines the denomination of the coin 1 and outputs the denomination discrimination signal to the second denomination discriminating section 63. There are some coins whose diameters are only slightly different from each other even though their denominations are different. When coins having a slightly larger diameter are worn out, their diameter can happen to coincide. Therefore, in some cases, the denomination of the coin 1 cannot be detected accurately by detecting its diameter. In this embodiment, the first discriminating means 53 determines the denomination of the coin 1 based on the magnetic properties of the coin 1 and outputs the denomination discrimination signal to the second denomination discriminating section 63. The first denomination discriminating section 61 of the second discriminating means 54 determines the denomination of the coin 1 based on the diameter of the coin 1 and outputs the denomination discrimination signal to the second denomination discriminating section 63. When the denominations of the coin 1 determined by the first discriminating means 53 and the first denomination discriminating section 61 of the second discriminating means 54 based on these denomination discrimination signals do not coincide, it is constituted to determine that the coin 1 cannot be accepted. Therefore, when the first denomination discriminating section 61 of the second discriminating means 54 determines only one kind of denomination of the coin 1 based on the diameter of the coin 1, produces the denomination discrimination signal and outputs it to the second denomination discriminating section 63, there is a possibility that the second denomination discriminating section 63 determines that the coin 1 is not acceptable even though the coin 1 is an acceptable coin. Accordingly, in this embodiment, the first denomination discriminating section 61 of the second discriminating means 54 selects two denominations whose diameters are the closest and the second closest to the diameter of the detected coin 1 and outputs the denomination discrimination signal to the second denomination discriminating section 63.

The second denomination discriminating section 63 determines the denomination of the coin 1 based on the denomination discrimination signal input from the first discriminating means 53 and the denomination discrimination signal input from the first denomination discriminating section 61 of the second discriminating means 54. When the determined results of the first discriminating means 53 and the first denomination discriminating section 61 of the second discriminating means 54 coincide, the second denomination discriminating section 63 outputs the denomination discrimination signal to the coin damage discriminating section 62, the binary data producing section 65 and the denomination determining section 66. When they do not coincide, the coin 1 is a counterfeit coin or a foreign coin and therefore, it determines that it is not acceptable and an unacceptable signal is output to the display means 58.

The coin damage discriminating section 62 reads the image pattern data of the lower surface of the coin 1 stored in the image pattern data memory 60 and calculates the chromaticity data and the lightness data of the coin 1 based on the R, G and B data in the image pattern data. Further, the coin damage discriminating section 62 accesses the second reference data memory 51, reads, based on the denomination discrimination signal input from the second denomination discriminating section 63, the reference chromaticity data and the reference lightness data of the coin having the denomination discriminated by the second denomination discriminating section 63 and compares the reference chromaticity data and the reference lightness data read from the second reference data memory 51 with the calculated chromaticity data and lightness data of the coin 1, thereby discriminating whether or not the coin 1 is damaged to higher than a predetermined level. More specifically, when the coin 1 is damaged to higher than a predetermined level, the color of the coin surface changes so that the difference between the chromaticity data of the coin 1 and the reference chromaticity data exceeds a predetermined level and the coin surface becomes dark so that the difference between the lightness data of the coin 1 and the reference lightness data exceeds a predetermined level. Therefore, the coin damage discriminating section 62 can discriminate whether or not the coin 1 is damaged to higher than a predetermined level by comparing the calculated chromaticity data and lightness data of the coin 1 with the reference chromaticity data and the reference lightness data. When the coin damage discriminating section 62 determines that the coin 1 is damaged to higher than a predetermined level, it outputs a damage determination signal to the denomination and acceptability discriminating means 56. At the same time, the coin damage discriminating section 62 outputs the damage determination signal to the display means 58 and cause it to display that the coin 1 is damaged to higher than a predetermined level.

On the other hand, the center coordinate determining section 64 determines the center coordinate of the image pattern data mapped and stored in the orthogonal coordinate system, namely, the x-y coordinate system and stored in the image pattern data memory 60 and outputs the center coordinate to the binary data producing section 65. The binary data producing section 65 reads the image pattern data of the lower surface of the coin 1 mapped and stored in the image pattern data memory 60 and binarizes them. The binary data producing section 65 groups the binarized image pattern data into the binary image pattern data groups of the denomination corresponding to the plurality of annular areas of the surface of the coin 1 based on the denomination discrimination signal input from the second denomination discriminating section 63 and the center coordinate signal input from the center coordinate determining section 64. The binary data producing section 65 further obtains the number of the "0" data in each binary image pattern data group corresponding to each annular area, obtains the ratio of the "0" data with respect to all the data, produces the ratio data of each binary image pattern data group corresponding to each annular area of the surface of the coin 1 and outputs the ratio data to the denomination determining section 66.

When the denomination determining section 66 receives the denomination discrimination signal from the second denomination discriminating section 63, it accesses the third reference data memory 52, at first, reads the reference ratio data of the reverse surface of the coin of the corresponding denomination from the reference ratio data stored in the third reference data memory 52 in accordance with the denomination discrimination signal input from the second denomination discriminating section 63, and compares the reference ratio data with the ratio data input from the binary data producing section 65, thereby discriminating the denomination of the coin 1.

When the denomination of the coin 1 is discriminated, the denomination determining section 66 calculates the absolute value Di (i=1 to n, n is the number of annular areas of the coin 1, which is predetermined for each denomination) of the difference between the reference ratio data of each binary image pattern group corresponding to each annular area of the coin 1 and the detected ratio data input from the binary data producing section 65. The denomination determining section 66 then determines whether or not the absolute values Di of the differences between the reference ratio data of each binary image pattern group corresponding to each annular area of the coin 1 and the detected ratio data are less than a predetermined value D0. As a result, when the absolute values Di of the differences between the reference ratio data of binary image pattern groups corresponding to all annular areas of the coin 1 and the detected ratio data are less than a predetermined value D0, the denomination determining section 66 further integrates the absolute values Di of the differences between the reference ratio data and the ratio data over all of the binary image pattern data groups corresponding to the annular areas of the coin 1, and determines whether or not the resulted integrated value I is less than a predetermined value I0. As a result, when the integrated value I is less than the predetermined value I0, the denomination determining section 66 determines that the coin 1 is the coin of the denomination determined by the second denomination discriminating section 63. Now, it should be noted that if the denomination of the coin 1 coincides with the denomination determined by the second denomination discriminating section 63, theoretically, the absolute value Di and the integrated value I become 0. However, because the surface of the coin 1 may be worn out or a detecting error may exist, they may not be equal to 0 even if the determined denominations coincide. Therefore, in this embodiment, when Di is less than D0 and, at the same time, I is less than I0, it is determined that the coin 1 is the coin of the denomination determined by the second denomination discriminating section 63.

To the contrary, when at least one absolute value Di of the differences between the reference ratio data of the binary image pattern data group corresponding to at least one of annular areas of the coin 1 and the detected ratio data are not less than the predetermined value D0, or when the absolute values Di of the differences between the reference ratio data of all binary image pattern data groups corresponding to all annular areas of the coin 1 are less than the predetermined value D0 and at the same time, the integrated value I is not less than the predetermined value I0, the denomination determining section 66 cannot determine that the denomination of the coin 1 is same as the denomination determined by the second denomination discriminating section 63. However, the coin 1 cannot be always fed such that its obverse surface faces upward and there are cases where the obverse surface of the coin 1 faces downward while it is advanced in the coin passage 2. As a result, there is a possibility that the surface pattern of the obverse surface of the coin 1 may be detected by the color sensor 24. Therefore, to determine that the coin 1 is not acceptable when the detected ratio data of the coin 1 do not coincide with the reference ratio data of the reverse surface of the coin of the denomination determined by the second denomination discriminating section 63 will significantly lower discriminating accuracy.

Thus, the denomination determining section 66 further accesses the third reference data memory 52, reads the reference ratio data of the obverse surface of the coin of the denomination determined by the second denomination discriminating section 63, and, in the exactly same manner as described above, it determines whether or not the absolute values Di of the differences between the reference ratio data of each binary image pattern group corresponding to each annular area of the coin 1 and the detected ratio data are less than a predetermined value D0. When the absolute values Di of the differences between the reference ratio data of all the binary image pattern groups corresponding to each annular area of the coin 1 and the detected ratio data are less than a predetermined value D0, the denomination determining section 66 integrates the absolute values Di of the differences between the reference ratio data of all the binary image pattern groups corresponding to each annular area of the coin 1, and determines whether or not the resulted integrated value I is less than the predetermined value I0. As a result, when the integrated value I is less than the predetermined value I0, the denomination determining section 66 determines that the coin 1 is the coin of the denomination determined by the second denomination discriminating section 63.

On the other hand, when at least one of absolute values Di of the differences between the reference ratio data of the binary image pattern groups corresponding to each annular area of the obverse surface of the coin 1 and the detected ratio data are not less than a predetermined value D0, or when the absolute values Di of the differences between the reference ratio data of the binary image pattern groups corresponding to all annular areas of the obverse surface of the coin 1 and the detected ratio data are less than a predetermined value D0 and at the same time, the integrated value I is not less than the predetermined value I0, it means that, as a result of comparing the reference ratio data of the coin of the denomination whose magnetic properties and diameter are closest among the denominations with the detected ratio data, the surface patterns of the obverse surface and the reverse surface of the coin 1 are different from the surface patterns of the coin of the denomination determined by the second denomination discriminating section 63. Therefore, since the coin 1 is either a counterfeit coin or a foreign coin and it is determined that it is not acceptable, the denomination determining section 66 outputs the unacceptable signal to the display means (not shown) and causes it to display that the coin 1 is not acceptable.

On the other hand, when the denomination determining section 66 determines that the coin 1 is acceptable, it outputs a denomination determination signal to the denomination and acceptability determining means 56.

After the pattern data of the lower surface of the coin 1 has been detected by the first pattern data detection unit 4, the coin is further fed downstream in the coin passage 2 by the transporting belt 6 and the lower surface thereof is supported by the transporting belt 7 disposed to project above the coin passage member 3 from the opening 7*a* formed in the coin passage member 3. As a result, the coin 1 is fed while it is being held between the transporting belt 6 and the transporting belt 7. The coin 1 is then pressed onto the lower surface of the coin passage forming member 8 by the transporting belt 7 and transported to the second transparent passage portion 10.

When the coin 1 is fed to the second transparent passage portion 10 and light emitted from the light emitting element 35 of each timing sensor 37 is blocked by the coin 1 and the light receiving element 36 does not receive the light emitted from the light emitting element 35, timing signals are output from the timing sensors 37, 37 to the light emission control means 40 and the image reading control means 41.

When the light emission control means 40 receives the timing signals from the timing sensors 37, 37, it outputs a light emission signal to the second light emitting means 31 based on the denomination discrimination signal from the first discriminating means 53 and causes the light emitting elements 30 to emit the amount of light that corresponds to the denomination of the coin 1 discriminated by the first discriminating means 53 toward the upper surface of the coin 1 located on the second transparent passage portion 10.

When the image reading control means 41 receives the timing signals from the timing sensors 37, 37, it causes the color sensor 34 of the second image data producing means 32 to start detecting the light emitted from the light emitting elements 30 and reflected on the upper surface of the coin 1.

The amount of light emitted from the light emitting elements 30 is controlled by the light emission control means 40 based on the denomination discrimination signal input from the first discriminating means 53 in the exactly same manner as described above as to the light emitting elements 20 of the first light emitting means 21.

Since the second light emitting means 31 is disposed so as to be able to illuminate the coin 1 which advances on the second transparent passage portion 10 at a shallow angle, the light is reflected according to the raised and depressed pattern of the upper surface of the coin 1. The light reflected from the surface of the coin 1 is directed toward the color sensor 34 by the lens system 33 and photoelectrically detected by the color sensor 34, whereby the image pattern data of the surface of the coin 1 are produced by the color sensor 34. The image pattern data of the surface of the coin 1 produced by the color sensor 34 are digitized by the A/D converter 38. The digitized image pattern data are mapped and stored in the orthogonal coordinate system, namely, x-y coordinate system in the image pattern data memory 70.

When the image pattern data of the upper surface of the coin 1 are stored in the image pattern data memory 70, the first denomination discriminating section 71 of the third discriminating means 55 accesses the second reference data memory 51. It reads the data stored in the second reference data memory 51 with regard to the diameter of the coin 1 and also the image pattern data stored in the image pattern data memory 70. By comparing those data, the first denomination discriminating section 71 of the third discriminating means 55 determines the denomination of the coin 1 and outputs a denomination discrimination signal to the second denomination discriminating section 73. In this embodiment, based on the detected diameter of the coin 1, the first denomination discriminating section 71 of the third discriminating means 55 selects two denominations, whose diameters are the closest and the second closest to the diameter of the detected coin 1 and outputs the denomination discrimination signal to the second denomination discriminating section 73.

The second denomination discriminating section 73 determines the denomination of the coin I based on the denomination discrimination signal input from the first discriminating means 53 and the denomination discrimination signal input from the first denomination discriminating section 71 of the third discriminating means 55. When the determined results of the first discriminating means 53 and the first denomination discriminating section 71 of the third discriminating means 55 coincide, the second denomination discriminating section 73 outputs a denomination discrimination signal to the coin damage discriminating section 72, the binary data producing section 75 and the denomination determining section 76. When they do not coincide, the coin 1 is a counterfeit coin or a foreign coin and, therefore, it determines that it is not acceptable and an unacceptable signal is output to the display means 58.

The coin damage discriminating section 72 reads the image pattern data of the upper surface of the coin 1 stored in the image pattern data memory 70 and calculates the chromaticity data and the lightness data of the coin 1 based on the R, G and B data in the image pattern data. Further, the coin damage discriminating section 72 accesses the second reference data memory 51, reads, based on the denomination discrimination signal input from the second denomination discriminating section 73, the reference chromaticity data and the reference lightness data of the coin having the denomination discriminated by the second denomination discriminating section 73 and compares the reference chromaticity data and the reference lightness data read from the second reference data memory 51 with the calculated chromaticity data and lightness data of the coin 1, thereby discriminating whether or not the coin 1 is damaged to higher than a predetermined level. When the coin damage discriminating section 72 determines that the coin 1 is damaged to higher than a predetermined level, it outputs a damage determination signal to the denomination and acceptability discriminating means 56. At the same time, the coin damage discriminating section 52 outputs the damage determination signal to the display means 58 and cause it to display that the coin 1 is damaged to higher than a predetermined level.

On the other hand, the center coordinate determining section 74 determines the center coordinate of the image pattern data mapped and stored in the orthogonal coordinate system, namely, the x-y coordinate system, and stored in the image pattern data memory 70 and outputs the center coordinate to the binary data producing section 75. The binary data producing section 75 reads the image pattern data of the upper surface of the coin 1 mapped and stored in the image pattern data memory 70 and binarizes them. The binary data producing section 75 groups the binarized image pattern data into the binary image pattern data groups of the denomination corresponding to the plurality of annular areas of the surface of the coin 1 based on the denomination discrimination signal input from the second denomination discriminating section 73 and the center coordinate signal input from the center coordinate determining section 74. The binary data producing section 75 further obtains the number of the "0" data in each binary image pattern data group corresponding to each annular area, obtains the ratio of the "0" data with respect to all the data, produces the ratio data of each binary image pattern data group corresponding to each annular area of the surface of the coin 1 and outputs the ratio data to the denomination determining section 76.

When the denomination determining section 76 receives the denomination discrimination signal from the second denomination discriminating section 73, it accesses the third reference data memory 52, reads the reference ratio data of the obverse and reverse surfaces of the coin of the corresponding denomination from the reference ratio data stored in the third reference data memory 52 in accordance with the denomination discrimination signal input from the second denomination discriminating section 73, and compares the reference ratio data with the ratio data input from the binary data producing section 75, thereby discriminating the denomination of the coin 1 in the exactly same manner as described above as to the denomination determining section 66 of the second discriminating means 54.

As a result, when the denomination determining section 76 determines that the coin 1 is a counterfeit coin or a foreign coin and that it is not acceptable, it outputs an unacceptable signal to the display means 58 and causes it to display that the coin 1 is not acceptable. On the other hand, when the denomination determining section 76 determines that the coin 1 is acceptable, it outputs a denomination determination signal to the denomination and acceptability determining means 56.

The denomination and acceptability determining means 56 makes the discrimination of the coin 1 based on the denomination discrimination signal input from the first discriminating means 53 and based on the magnetic properties of the coin 1, the denomination discrimination signal input from the denomination determining section 66 of the second discriminating means 54 and based on the diameter data and the image pattern data of the coin 1, the presence of the damage discrimination signal input from the coin damage discriminating section 62 and based on the chromaticity data and the lightness data of the coin 1, the denomination discrimination signal input from the denomination determining section 76 of the third discriminating means 55 and based on the diameter data and the image pattern data of the coin 1 and the presence of the damage discrimination signal input from the coin damage discriminating section 72 and based on the chromaticity data and the lightness data of the coin 1. When the denomination and acceptability determining means 56 finds that the denominations determined by the first discriminating means 53, the second discriminating means 54 and the third discriminating means 55 coincide with each other, it discriminates that the coin 1 is acceptable. On the other hand, when they do not coincide with each other, the denomination and acceptability determining means 56 discriminates that the coin 1 is either a counterfeit coin or a foreign coin and is not acceptable and outputs an unacceptable signal to the display means 58 to cause it to display that the coin 1 is not acceptable. More specifically, for example, when the second discriminating means 54 discriminates that the pattern data of the lower surface of the coin 1 coincide with the reference pattern of the obverse surface of a coin of a certain denomination and the third discriminating means 55 determines that the pattern data of the upper surface of the coin 1 coincide with the reference pattern of the reverse surface of the coin of the denomination or in the case where Euro coins are to be discriminated, when one of the second discriminating means 54 and the third discriminating means 55 discriminates that a common pattern is formed on one side surface of the coin 1 and the other of the second discriminating means 54 and the third discriminating means 55 discriminates that a pattern peculiar to an issuing country is formed on the other side surface of the coin 1, the denomination and acceptability determining means 56 determines that the coin 1 is acceptable only when the denomination of the coin 1 determined by the second discriminating means 54 and the third discriminating means 55 coincides with the denomination of the coin 1 determined by the first discriminating means 53 and determines that the coin 1 is the coin of the denomination determined by the first discriminating means 53, the second discriminating means 54 and the third discriminating means 55. Otherwise, the denomination and acceptability determining means 56 determines that the coin 1 is an unacceptable coin.

In this manner, coins discriminated as unacceptable are sorted and collected separately from coins discriminated as acceptable. Further, even though it is discriminated that a coin is acceptable, when it is discriminated that at least one surface thereof is damaged to higher than a predetermined level, it is collected separately from coins discriminated as acceptable.

In the above described embodiment, in the region of the first pattern data detection unit 4, a coin 1 is transported while it is being pressed onto the upper surface of the first transparent passage portion 9 formed in the coin passage member 3 by the transporting belt 6 and is irradiated via the first transparent portion 9 with light emitted from the light emitting elements 20 disposed below the coin passage member 3 and light reflected from the lower surface of the coin 1 is photoelectrically detected by the color sensor 24, thereby producing pattern data of the lower surface of the coin 1. Further, the coin 1 is transported while the lower surface thereof is being supported by the transporting belt 7 disposed to project above the coin passage member 3 from the opening 7*a* formed in the coin passage member 3 so that it is being pressed onto the lower surface of the coin passage forming member 8 provided above the transporting belt 7 and is irradiated via the second transparent passage portion 10 formed in the coin passage forming member 8 with light emitted from the light emitting elements 30 disposed above the coin passage forming member 8 and light reflected from the upper surface of the coin 1 is photoelectrically detected by the color sensor 34, thereby producing pattern data of the upper surface of the coin 1. Therefore, according to the above described embodiment, it is possible to detect optical patterns of both surfaces of a coin 1 in a desired manner while the coin 1 is being transported and to discriminate, based on the thus obtained pattern data of both surfaces of the coin 1, whether or not the coin 1 is acceptable, the denomination of the coin 1 and damage degree of the coin 1.

Further, according to the above described embodiment, patterns of both surfaces of the coin 1 are detected for discriminating whether or not the coin 1 is acceptable. Therefore, it is possible to sort coins such as Euro coins on one surface of which a common pattern is formed and on the other surface of which: a different pattern is formed depending upon the issuing countries, into coins of each issuing country, as occasion demands. Further, since patterns of both surfaces of a coin 1 are detected for discriminating whether or not the coin 1 is damaged to higher than a predetermined level, it is possible to reliably discriminate the coin one of the surfaces of which is damaged to higher than a predetermined level as a damaged coin and collect it.

Furthermore, according to the above described embodiment, the first discriminating means 53 discriminates the denomination of a coin 1 based on magnetic properties of the coin 1 detected by the magnetic sensors 12, 12, the first denomination discriminating section 61 of the second discriminating means 54 discriminates the denomination of the coin 1 based on the diameter of the coin 1 and the second denomination discriminating section 63 of the second discriminating means 54 is constituted so as to tentatively determine the denomination of the coin 1 based on the discriminating results made by the first discriminating means 53 and the first denomination discriminating section 61 of the second discriminating means 54. The denomination determining section 66 of the second discriminating means 54 discriminates the denomination of the coin 1 by comparing the pattern data of the coin 1 with only the reference data of the coin of the denomination determined by the first denomination discriminating section 61 of the second discriminating means 54 and the third discriminating means 55 discriminates the denomination of the coin 1 in the same manner as in the second discriminating means 54. Whether or not the coin 1 is acceptable and the denomination of the coin 1 are finally discriminated based on the discriminating results made by the first discriminating means 53, the second discriminating means 54 and the third discriminating means 55. Therefore, it is possible to shorten the time required to make discrimination of coins and discriminate whether or not the coin 1 is acceptable and the denomination of the coin 1 with high accuracy in comparison with the case where the coin discrimination is made by comparing the pattern data of the coin 1 with reference data of coins of all denominations.

Moreover, according to the above described embodiment, when the light reflectivity of the material constituting the coin 1 is low, control is effected such that the amount of light emitted from the light emitting elements 20, 30 which illuminates the coin 1 is increased, and when the light reflectivity of the material constituting the coin 1 is high, control is effected such that the amount of light emitted from the light emitting elements 20, 30 which illuminates the coin 1 is decreased. As a result, irrespective of the material, i.e., whether or not the coin 1 is made of a material having a high or low light reflectivity, it is always possible to produce the binary data in accordance with the surface pattern of the coin 1 and accurately determine the denomination of the coin 1 and whether or not the coin 1 is acceptable. Further, by comparing the obtained data by calculating the ratio of the "0" data in each pattern data group corresponding to each annular area of the coin 1 with the reference ratio data obtained in advance, the denomination of the coin 1 and whether or not the coin 1 is acceptable are determined. Therefore, even in the case where the coin 1 is rotated with respect to the reference position, without rotating the resulted pattern data of the coin 1 in order to compare with the reference pattern data, it is possible to determine the denomination of the coin 1 and whether or not the coin 1 is acceptable in a shorter time.

Figure 6:
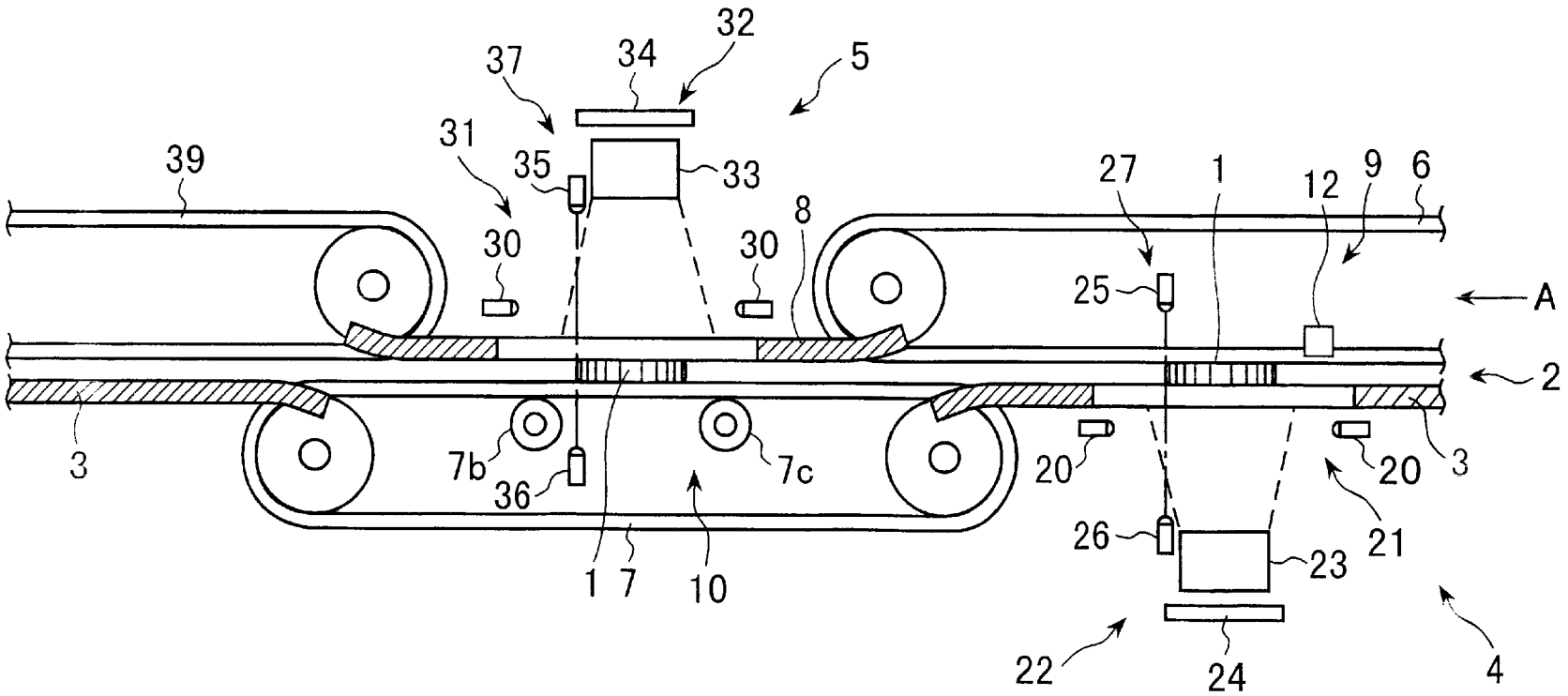
FIG. 6 is a schematic longitudinal cross-sectional view of a coin discriminating apparatus which is another preferred embodiment of the present invention.

FIG. 6 is a schematic longitudinal cross-sectional view of a coin discriminating apparatus which is another preferred embodiment of the present invention.

As shown in FIG. 6, in the coin discriminating apparatus according to this embodiment, the coin passage member 3 is cut off over a region extending from an upstream portion of the second pattern data detection unit 5 to a downstream portion thereof and a transporting belt 7 is provided there so as to be disposed above the upper surface of the coin passage member 3. Therefore, a coin 1 which has been transported by the transporting belt 6 while the lower surface thereof has been supported by the upper surface of the coin passage member 3 is fed to the second pattern data detection unit 5 while the lower surface thereof is being supported by the transporting belt 7.

When pattern data of the upper surface of the coin 1 are detected by the second pattern data detection unit 5, the coin 1 is further fed downstream in the coin passage 2 while it is being pressed onto the upper surface of the coin passage member 3 by a transporting belt 39.

In this embodiment, in the region of the first pattern data detection unit 4, a coin 1 is transported while it is being pressed onto the upper surface of the first transparent passage portion 9 formed in the coin passage member 3 by the transporting belt 6 and is irradiated via the first transparent portion 9 with light emitted from the light emitting elements 20 disposed below the coin passage member 3 and light reflected from the lower surface of the coin 1 is photoelectrically detected by the color sensor 24, thereby producing pattern data of the lower surface of the coin 1. Further, the coin 1 is delivered from the coin passage member 3 onto transporting belt 7 and transported while the lower surface thereof is being supported by the transporting belt 7 so that it is being pressed onto the lower surface of the coin passage forming member 8 provided above the transporting belt 7 and is irradiated via the second transparent passage portion 10 formed in the coin passage forming member 8 with light emitted from the light emitting elements 30 disposed above the coin passage forming member 8 and light reflected from the upper surface of the coin 1 is photoelectrically detected by the color sensor 34, thereby producing pattern data of the upper surface of the coin 1. Therefore, according to the above described embodiment, it is possible to detect optical patterns of both surfaces of a coin 1 in a desired manner while the coin 1 is being transported and to discriminate, based on the thus obtained pattern data of both surfaces of the coin 1, whether or not the coin 1 is acceptable, the denomination of the coin 1 and damage degree of the coin 1.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, the denomination of a coin 1 and whether or not a coin 1 is acceptable are discriminated by comparing ratio data obtained by photoelectrically detecting patterns of both surfaces of the coin 1 and calculating a ratio of the "0" data in each pattern data group corresponding to each annular area with the reference ratio data determined in advance. However, instead, as taught in U.S. Pat. No. 5,538,123, it is possible to discriminate whether or not the coin 1 is acceptable and the denomination of the coin 1 by mapping pattern data of each surface of the coin 1 mapped and stored in the x-y coordinate system into an r-θ coordinate system, thereby producing r-θ coordinate pattern data of each surface of the coin 1 and effecting pattern matching between them and reference pattern data of the coin of each denomination mapped into the r-θ coordinate system and stored in a memory.

Further, in the above described embodiments, whether or not a coin 1 is acceptable, the denomination of a coin 1 and the damage degree of both surfaces of a coin 1 are discriminated by the first pattern data detection unit 4 and the second pattern data detection unit 5. However, as disclosed in Japanese Patent Application No. 11-118277, it is possible to discriminate only whether or not a coin 1 is acceptable and the denomination of a coin 1 using a monochromatic type CCD instead of the color sensor 24 of the first pattern data detection unit 4 and a monochromatic type CCD instead of the color sensor 34 of the first pattern data detection unit 5 and to discriminate damage degree of a coin 1 by providing a first coin damage degree discriminating unit for discriminating damage degree of the upper surface of a coin 1 and a second coin damage degree discriminating unit for discriminating damage degree of the lower surface of a coin 1 in the coin passage 2 downstream of the second pattern data detection unit 5. In this case, it is possible to constitute the region of the first coin damage degree discriminating unit similarly to the region of the first pattern data detection unit 4, so as to form a third transparent passage portion in the coin passage member 3 constituting the lower surface of the coin passage 2 so that a coin 1 is transported while it is being pressed onto the upper surface of the coin passage member 3 by a transporting belt provided above the coin passage member 3 and provide, below the third transparent passage portion, a white light source for illuminating white light onto the lower surface of the coin 1 via the third transparent passage portion and a single-element type color sensor for detecting light emitted from the white light source and reflected from the lower surface of the coin 1, and to constitute the region of the second coin damage degree discriminating unit so as to support the lower surface of the coin 1 by a transporting belt provided to project upward from an opening formed in the coin passage member 3 or a transporting belt provided in a portion where the coin passage member 3 is cut off and disposed above the upper surface of the coin passage member 3, form a fourth transparent passage portion in the coin passage forming member 8 provided above the transporting belt, press the coin 1 onto the lower surface of the coin passage forming member 8, thereby transporting it and provide, above the fourth transparent passage portion, a white light source for illuminating white light onto the upper surface of the coin 1 via the fourth transparent passage portion and a single-element type color sensor for detecting light emitted from the white light source and reflected from the upper surface of the coin 1, whereby damage degree of each surface of the coin 1 can be discriminated by producing chromaticity data and lightness data based on color data of each surface of the coin 1 and comparing them with the reference chromaticity data and the reference lightness data of coins of each denomination.

Furthermore, in the above described embodiments, whether or not a coin 1 is acceptable, the denomination of a coin 1 and the damage degree of both surfaces of a coin 1 are discriminated by the first pattern data detection unit 4 and the second pattern data detection unit 5. However, as disclosed in Japanese Patent Application No. 11-118277, it is possible to discriminate only whether or not a coin 1 is acceptable and the denomination of a coin 1 using a monochromatic type CCD instead of the color sensor 24 of the first pattern data detection unit 4 and a monochromatic type CCD instead of the color sensor 34 of the first pattern data detection unit 5 and provide, in the coin passage 2 downstream of the second pattern data detection unit 5, a first coin damage degree discriminating unit for discriminating damage degree of the lower surface of the coin 1, the first coin damage degree discriminating unit comprising a photosensor, a first LED light source for emitting light corresponding to R component, a second LED light source for emitting light corresponding to G component and a third LED light source for emitting light corresponding to B component, the first LED light source, the second LED light source and the third LED light source being disposed around the photosensor and spaced from each other by 120 degrees, and a second coin damage degree discriminating unit for discriminating damage degree of the upper surface of the coin 1, the second coin damage degree discriminating unit comprising a photosensor, a first LED light source for emitting light corresponding to R component, a second LED light source for emitting light corresponding to G component and a third LED light source for emitting light corresponding to B component, the first LED light source, the second LED light source and the third LED light source being disposed around the photosensor and spaced from each other by 120 degrees. In this case, it is possible to constitute the region of the first coin damage degree discriminating unit similarly to the region of the first pattern data detection unit 4, so as to form a third transparent passage portion in the coin passage member 3 constituting the lower surface of the coin passage 2 so that a coin 1 is transported while it is being pressed onto the upper surface of the coin passage member 3 by a transporting belt provided above the coin passage member 3 and to constitute the region of the second coin damage degree discriminating unit so as to support the lower surface of the coin 1 by a transporting belt provided to project upward from an opening formed in the coin passage member 3 or a transporting belt provided in a portion where the coin passage member 3 is cut off and disposed above the upper surface of the coin passage member 3, form a fourth transparent passage portion in the coin passage forming member 8 provided above the transporting belt, press the coin 1 onto the lower surface of the coin passage forming member 8, thereby transporting it, and damage degree of each surface of the coin 1 can be discriminated by producing chromaticity data and lightness data based on R data, G data and B data of each surface of the coin 1 produced by actuating the first LED light source, the second LED light source and the third LED light source in the region of the first coin damage degree discriminating unit and the first LED light source, the second LED light source and the third LED light source in the region of the second coin damage degree discriminating unit in a time-sharing manner, respectively, and detecting light reflected from each surface of the coin 1 by the photosensor, and comparing them with the reference chromaticity data and the reference lightness data of coins of each denomination.

Moreover, in the above described embodiments, although the first pattern data detection unit 4 is provided upstream of the second pattern data detection unit 5 with respect to the transporting direction of the coin 1, it is not absolutely necessary to provide the first pattern data detection unit 4 upstream of the second pattern data detection unit 5 and the first pattern data detection unit 4 may be provided downstream of the second pattern data detection unit 5. Similarly, in the case where a first coin damage degree discriminating unit and a second coin damage degree discriminating unit are provided in the coin passage 2 downstream of the first pattern data detection unit 4 and the second pattern data detection unit 5, the first coin damage degree discriminating unit may be provided upstream of the second coin damage degree discriminating unit or the second coin damage degree discriminating unit may be provided upstream of the first coin damage degree discriminating unit. Namely, it is possible to arbitrarily determine the positional relationship between the first pattern data detection unit 4 and the second pattern data detection unit 5 and the positional relationship between the first coin damage degree discriminating unit and the second coin damage degree discriminating unit.

Further, in this specification and the appended claims, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a coin discriminating apparatus capable of discriminating whether or not coins are acceptable and the denominations of coins with high accuracy even when the coins has a common pattern on one side surface thereof but a different pattern on the other side surface thereof like Euro coins.

Further, according to the present invention, it is possible to provide a coin discriminating apparatus capable of discriminating whether or not coins are damaged to higher than a predetermined level with high accuracy.

What is claimed is:

1. A coin discriminating apparatus comprising a coin passage member for supporting a lower surface of a coin, a first transporting belt disposed above the coin passage member adapted for forming a coin passage between the coin passage member and itself and holding the coin between the coin passage member and itself, thereby transporting it, a first light source for emitting light via a first transparent passage portion formed in the coin passage member toward the lower surface of the coin being transported on the coin passage member, first light receiving means for photoelectrically detecting light emitted from the first light source and reflected from the lower surface of the coin via the first transparent portion and producing image pattern data of the lower surface of the coin, a second transporting belt for supporting the lower surface of the coin, a coin passage forming member disposed above the second transporting belt for forming the coin passage between the lower surface thereof and the second transporting belt and holding the coin between the lower surface thereof and the second transporting belt, thereby transporting it, a second light source for emitting light via a second transparent passage portion formed in the coin passage forming member toward an upper surface of the coin being supported and transported by. the second transporting belt, second light receiving means for photoelectrically detecting light emitted from the second light source and reflected from the upper surface of the coin via the second transparent portion and producing image pattern data of the upper surface of the coin, first pattern data storing means for storing the image pattern data of the lower surface of the coin produced by the first light receiving means, second pattern data storing means for storing the image pattern data of the upper surface of the coin produced by the second light receiving means, reference pattern data storing means for storing reference pattern data of coins of each denomination, discriminating means for comparing the image pattern data of the lower surface of the coin stored in the first pattern data storing means with the reference pattern data of coins of each denomination stored in the reference pattern data storing means and comparing the image pattern data of the upper surface of the coin stored in the second pattern data storing means with the reference pattern data of coins of each denomination stored in the reference pattern data storing means, thereby discriminating whether or not the coin is acceptable and the denomination of the coin.

2. A coin discriminating apparatus in accordance with claim 1 wherein the second transporting belt is provided so as to project upward from an opening formed in the coin passage member.

3. A coin discriminating apparatus in accordance with claim 1 wherein the coin passage member is cut off in the region of the second transporting belt.

4. A coin discriminating apparatus in accordance with claim 1 wherein the first light source is disposed upstream of the second light source with respect to a coin transporting direction.

5. A coin discriminating apparatus in accordance with claim 1 wherein the first light source is disposed downstream of the second light source with respect to a coin transporting direction.

6. A coin discriminating apparatus in accordance with claim 1 wherein the first light receiving means and the second light receiving means are constituted as monochromatic type sensors and which further comprises a third transporting belt for holding the coin between the coin passage member and itself, thereby transporting it, a third light source for emitting light toward the lower surface of the coin being transported on the coin passage member by the third transporting belt via a third transparent passage portion formed in the coin passage member, third light receiving means for photoelectrically detecting light emitted from the third light source and reflected from the lower surface of the coin via the third transparent passage portion and producing color data of the lower surface of the coin, a fourth transporting belt for supporting the lower surface of the coin, a coin passage forming member disposed above the fourth transporting belt for forming the coin passage between the lower surface thereof and the fourth transporting belt and holding the coin between the lower surface thereof and the fourth transporting belt, thereby transporting it, a fourth light source for emitting light toward the upper surface of the coin being supported and transported by the fourth transporting belt via a fourth transparent passage portion, fourth light receiving means for photoelectrically detecting light emitted from the fourth light source and reflected from the upper surface of the coin via the fourth transparent passage portion and producing color data of the upper surface of the coin, first color data storing means for storing color data of the lower surface of the coin produced by the third light receiving means, second color data storing means for storing color data of the upper surface of the coin produced by the fourth light receiving means, and reference color data storing means for storing color data of coins of each denomination, the discriminating means being constituted so as to compare the color data of the lower surface of the coin stored in the first color data storing means with the reference color data of coins of each denomination stored in the reference color data storing means and compare the color data of the upper surface of the coin stored in the second color data storing means with the reference color data of coins of each denomination stored in the reference color data storing means, thereby discriminating damage degree of the coin.

7. A coin discriminating apparatus in accordance with claim 2 wherein the first light receiving means and the second light receiving means are constituted as monochromatic type sensors and which further comprises a third transporting belt for holding the coin between the coin passage member and itself, thereby transporting it, a third light source for emitting light toward the lower surface of the coin being transported on the coin passage member by the third transporting belt via a third transparent passage portion formed in the coin passage member, third light receiving means for photoelectrically detecting light emitted from the third light source and reflected from the lower surface of the coin via the third transparent passage portion and producing color data of the lower surface of the coin, a fourth transporting belt for supporting the lower surface of the coin, a coin passage forming member disposed above the fourth transporting belt for forming the coin passage between the lower surface thereof and the fourth transporting belt and holding the coin between the lower surface thereof and the fourth transporting belt, thereby transporting it, a fourth light source for emitting light toward the upper surface of the coin being supported and transported by the fourth transporting belt via a fourth transparent passage portion, fourth light receiving means for photoelectrically detecting light emitted from the fourth light source and reflected from the upper surface of the coin via the fourth transparent passage portion and producing color data of the upper surface of the coin, first color data storing means for storing color data of the lower surface of the coin produced by the third light receiving means, second color data storing means for storing color data of the upper surface of the coin produced by the fourth light receiving means, and reference color data storing means for storing color data of coins of each denomination, the discriminating means being constituted so as to compare the color data of the lower surface of the coin stored in the first color data storing means with the reference color data of coins of each denomination stored in the reference color data storing means and compare the color data of the upper surface of the coin stored in the second color data storing means with the reference color data of coins of each denomination stored in the reference color data storing means, thereby discriminating damage degree of the coin.

8. A coin discriminating apparatus in accordance with claim 3 wherein the first light receiving means and the second light receiving means are constituted as monochromatic type sensors and which further comprises a third transporting belt for holding the coin between the coin passage member and itself, thereby transporting it, a third light source for emitting light toward the lower surface of the coin being transported on the coin passage member by the third transporting belt via a third transparent passage portion formed in the coin passage member, third light receiving means for photoelectrically detecting light emitted from the third light source and reflected from the lower surface of the coin via the third transparent passage portion and producing color data of the lower surface of the coin, a fourth transporting belt for supporting the lower surface of the coin, a coin passage forming member disposed above the fourth transporting belt for forming the coin passage between the lower surface thereof and the fourth transporting belt and holding the coin between the lower surface thereof and the fourth transporting belt, thereby transporting it, a fourth light source for emitting light toward the upper surface of the coin being supported and transported by the fourth transporting belt via a fourth transparent passage portion, fourth light receiving means for photoelectrically detecting light emitted from the fourth light source and reflected from the upper surface of the coin via the fourth transparent passage portion and producing color data of the upper surface of the coin, first color data storing means for storing color data of the lower surface of the coin produced by the third light receiving means, second color data storing means for storing color data of the upper surface of the coin produced by the fourth light receiving means, and reference color data storing means for storing color data of coins of each denomination, the discriminating means being constituted so as to compare the color data of the lower surface of the coin stored in the first color data storing means with the reference color data of coins of each denomination stored in the reference color data storing means and compare the color data of the upper surface of the coin stored in the second color data storing means with the reference color data of coins of each denomination stored in the reference color data storing means, thereby discriminating damage degree of the coin.

9. A coin discriminating apparatus in accordance with claim 6 wherein the fourth transporting belt is provided so as to project upward from an opening formed in the coin passage member.

10. A coin discriminating apparatus in accordance with claim 7 wherein the fourth transporting belt is provided so as to project upward from an opening formed in the coin passage member.

11. A coin discriminating apparatus in accordance with claim 8 wherein the fourth transporting belt is provided so as to project upward from an opening formed in the coin passage member.

12. A coin discriminating apparatus in accordance with claim 6 wherein the coin passage member is cut off in the region of the fourth transporting belt.

13. A coin discriminating apparatus in accordance with claim 7 wherein the coin passage member is cut off in the region of the fourth transporting belt.

14. A coin discriminating apparatus in accordance with claim 8 wherein the coin passage member is cut off in the region of the fourth transporting belt.

15. A coin discriminating apparatus in accordance with claim 6 wherein the third light source is disposed upstream of the fourth light source with respect to a coin transporting direction.

16. A coin discriminating apparatus in accordance with claim 7 wherein the third light source is disposed upstream of the fourth light source with respect to a coin transporting direction.

17. A coin discriminating apparatus in accordance with claim 8 wherein the third light source is disposed upstream of the fourth light source with respect to a coin transporting direction.

18. A coin discriminating apparatus in accordance with claim 6 wherein the third light source is disposed downstream of the fourth light source with respect to a coin transporting direction.

19. A coin discriminating apparatus in accordance with claim 7 wherein the third light source is disposed downstream of the fourth light source with respect to a coin transporting direction.

20. A coin discriminating apparatus in accordance with claim 8 wherein the third light source is disposed downstream of the fourth light source with respect to a coin transporting direction.

* * * * *